US005320270A

United States Patent [19]

Crutcher

[11] Patent Number: 5,320,270

[45] Date of Patent: Jun. 14, 1994

[54] ELECTROMECHANICAL FASTENER DRIVING TOOL

[75] Inventor: John P. Crutcher, Cincinnati, Ohio

[73] Assignee: Sencorp, Newport, Ky.

[21] Appl. No.: 12,884

[22] Filed: Feb. 3, 1993

[51] Int. Cl.[5] ..... B25C 1/06

[52] U.S. Cl. ..... 227/131; 227/134; 173/121

[58] Field of Search ..... 227/131, 133, 134, 147; 173/53, 121, 122, 13

[56] References Cited

U.S. PATENT DOCUMENTS 4,161,272 7/1979 Brockl ..... 227/131

4,323,127 4/1982 Cunningham ..... 227/131 X 4,964,558 10/1990 Crutcher et al. ..... 227/131 X 5,098,004 3/1992 Kerrigan ..... 227/134

*Primary Examiner*—Rinaldi Rada

*Attorney, Agent, or Firm*—Jerrold J. Litzinger

[57] ABSTRACT

An electromechanical tool for driving fasteners into a workpiece. The tool uses a single flywheel in combination with a clutch mechanism whereby a conically shaped flywheel frictionally cooperates with a corresponding drum to cause a driver which is coupled to the drum by a cable to be pulled with considerable force through a working stroke to drive a fastener from the tool.

30 Claims, 13 Drawing Sheets

ELECTROMECHANICAL FASTENER DRIVING TOOL

BACKGROUND OF THE INVENTION

1. Field of the Invention

The invention relates generally to an electromechanical fastener driving tool, and, in particular, to a fastener driving tool which uses a cone clutch to couple a flywheel to a fastener driving device.

2. Description of the Prior Art

Prior art workers have devised many types of mechanically operated fastener driving tools utilizing driving means actuated pneumatically, electromechanically or by internal combustion. To date, pneumatically actuated fastener driving tools are the ones most frequently encountered. While pneumatically actuated tools work well and have become quite sophisticated, they nevertheless require the presence of a compressor or the like.

There are many job sites where a source of compressed air is not normally present. This is particularly true of smaller job sites and the like. On the other hand, electricity is almost always present on such sites. As a consequence, particularly in recent years, prior art workers have directed considerable attention to electromechanical tools.

Some prior art electromechanical tools depend upon a heavy duty solenoid to do the fastener driving. In general, however, such tools are not adequate where large driving forces are required or desired. As a consequence, prior art workers have also expended considerable thought and effort in the development of electromechanical fastener driving tools employing one or more flywheels. Examples of such tools are taught in U.S. Pat. Nos. 4,042,036; 4,121,745; 4,204,622; and 4,298,072. Yet another example is taught in British Pat. No. 2,000,716.

It will be evident from these patents that prior art workers have devoted a great deal of time to the development of flywheel fastener driving tools. Nevertheless, such tools do present their own unique problems. For example, in tools utilizing two flywheels, it has been the practice to provide a separate electric motor for each flywheel. This adds considerably to the weight and bulk of the tool and is difficult to synchronize. Another approach is to mount one of the flywheels on the electric motor shaft and then drive the second flywheel through a series of belts or chains and pulleys. Such drives are complex, difficult to adjust, and are subject to wear.

Another problem area involved means to cause one of the flywheels to move toward and away from the other. Preferably, for example, one of the flywheels is capable of shifting toward the other and into an operative position wherein its periphery is spaced from that of the stationary flywheel by a distance less than the nominal thickness of the thick part of the driver. The same flywheel is shiftable in the opposite direction to an inoperative position wherein its periphery is spaced from that of the fixed flywheel by a distance greater than the greatest nominal thickness of the driver. Heretofore, systems to bring about this shifting of one of the flywheels with respect to the other have been cumbersome, complex and not altogether satisfactory.

Yet another area of concern has involved means for returning the driver at the end of the drive stroke to its normal, retracted position. For these purposes, prior art workers have developed complex systems of springs, pulleys and elastomeric cords. Such systems, however, have proven to be subject to wear, stretching and deterioration due to lubricants and foreign materials within the tool housing. Other systems have employed a powered return roller and an idler roller which shifted a free floating driver to its normal position after the drive stroke. These systems were also found to be less than satisfactory.

Consequently, heretofore there has not been available in the industry a reliable, lightweight and relatively simple electromechanical fastener driving tool which can efficiently drive fasteners of various sizes, particularly those sizes needed in heavy duty framing applications.

However, a novel solution to these problems has been found with the use of a frictional clutch mechanism. These mechanisms are common in other types of mechanical devices. U.S. Pat. Nos. 2,291,151; 4,030,581; 4,416,3590; 4,526,052; and 4,545,469 all teach the use of clutch mechanisms to transfer energy from one mechanism to another. This energy transfer may be accomplished using several different methods. By employing this concept within a fastener driving tool, it is possible to overcome the aforementioned problems which have prevented the prior art electromechanical fastener driving tools from being accepted commercially.

SUMMARY OF THE INVENTION

It is therefore an object of the present invention to provide an electromechanical fastener driving tool which is of relatively small size and weight.

It is a further object of the present invention to provide a simple and reliable return system for the driver of an electromechanical tool.

It is a still further object of the present invention to provide an electric tool which is capable of driving a large range of fastener sizes.

These and other objects of the present invention are accomplished by a novel fastener driving tool which uses a single flywheel in combination with a clutch mechanism. A conically shaped flywheel frictionally cooperates with a corresponding shaped drum to which a driver is coupled by a cable. Upon activation, a clutch actuator moves the drum into frictional engagement with the rotating flywheel, causing the driver to be pulled with considerable force from a normal unactuated position through a working stroke to drive a fastener from a magazine located on the underside of the tool. Return of the driver is accomplished by a torsion spring which is tensioned as the drum is rotated during the driving stroke of the tool.

DETAILED DESCRIPTION OF THE PREFERRED EMBODIMENT

Figure 1:
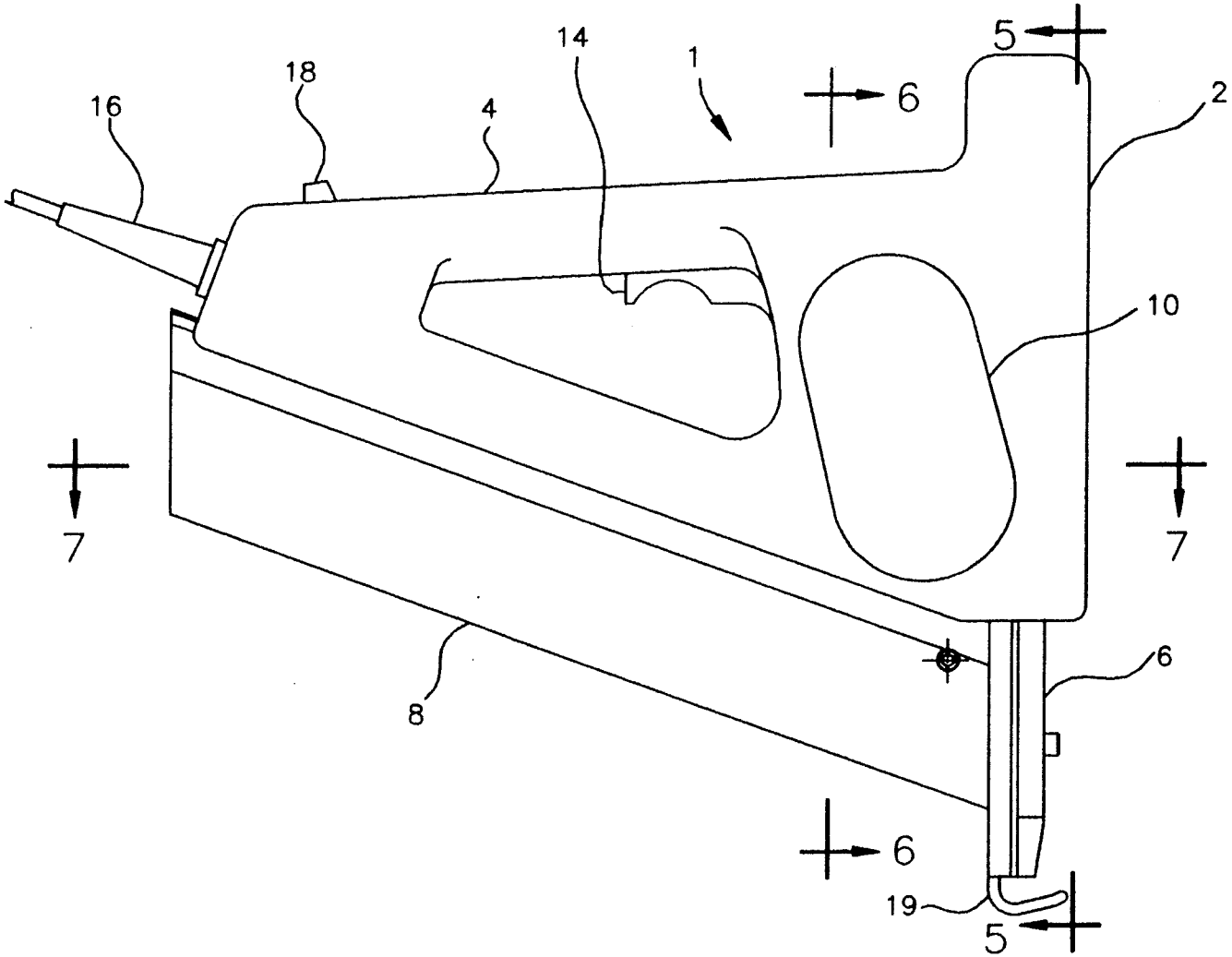
FIG. 1 is a fragmentary elevational view of an exemplary fastener driving tool of the present invention.
Figure 2:
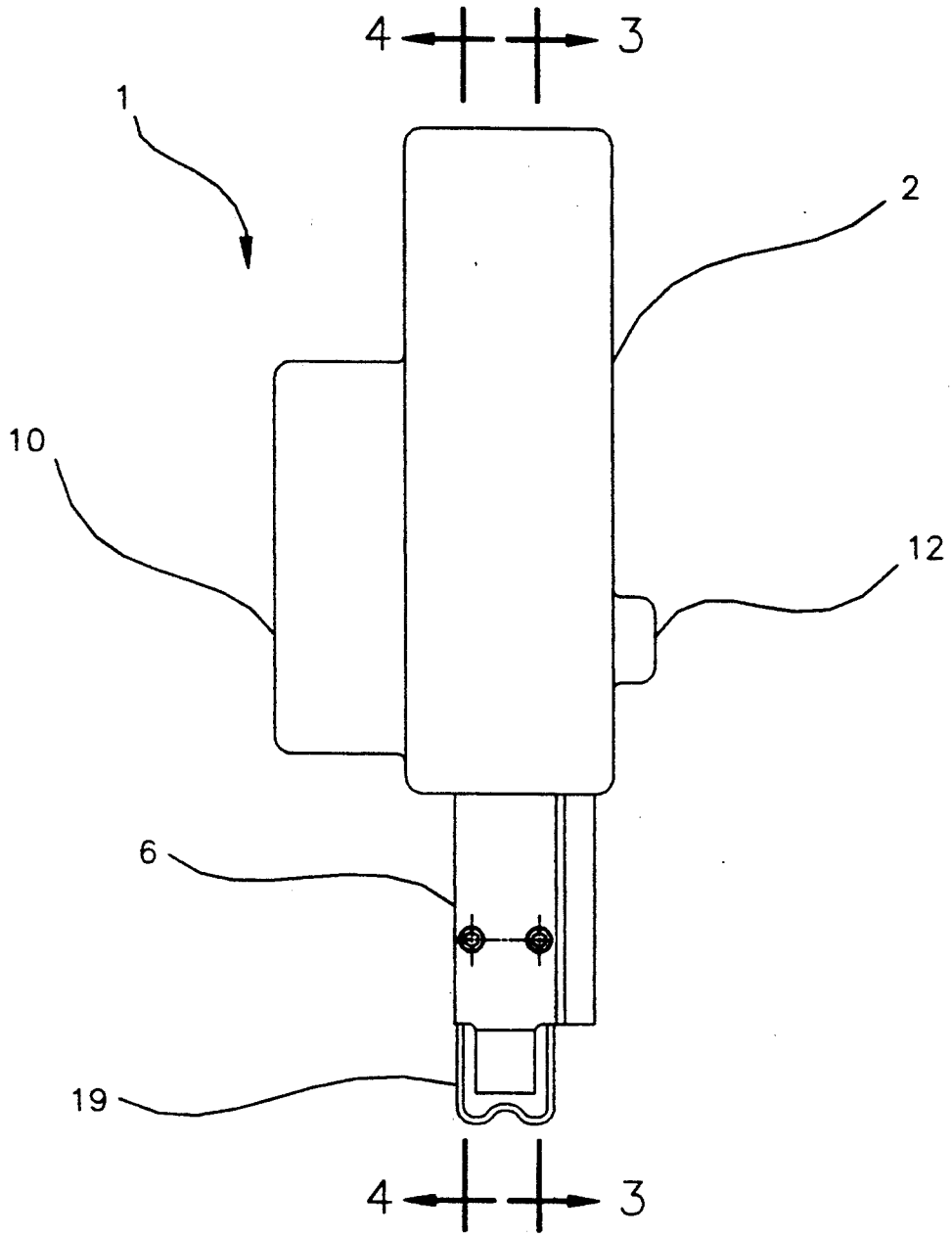
FIG. 2 is a front elevational view of the tool shown in FIG. 1.

An exemplary embodiment of the fastener driving tool of the present invention is illustrated in FIGS. 1 and 2. The tool is generally indicated at 1 and comprises a main body portion 2, a handle portion 4, a guide body 6, and a magazine portion 8. Main body portion 2 contains a motor housing compartment 10 for accommodating a motor and a flywheel, and a shaft housing compartment 12 for accommodating the end of a shaft which holds the flywheel and clutch actuator.

Figure 6:
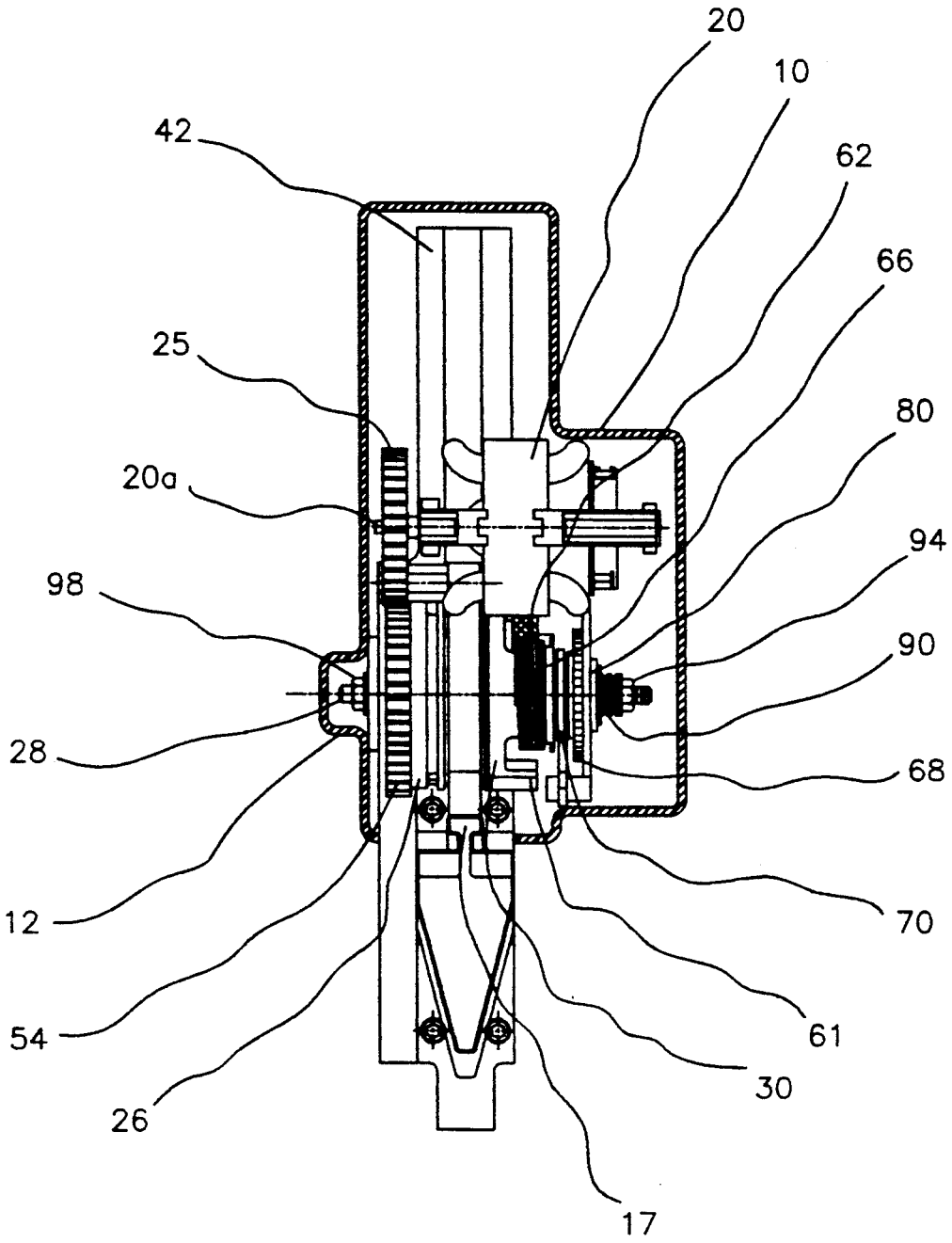
FIG. 6 is a cross-sectional view taken along section line 6—6 of FIG. 1.

The underside of handle portion 4 contains a trigger 14, while a power cord 16 is attached to tool 1 at the rear end of handle portion 4. Guide body 6, which is affixed to the front end of magazine 8 at the lower end of main body portion 2, provides a drive track 17 (FIG. 6) for the driver blade of tool 1 and for the fasteners contained in magazine 8. A switch 18 for controlling the current to the motor is also located on handle portion 4.

A tool of the type being described is normally provided with a safety interlock. The most common type of safety comprises a workpiece contacting safety 19 which, when the nose piece end of guide body 6 is placed against a workpiece, contacts the workpiece and is urged upwardly thereby, as viewed in FIG. 1. Safety 19 normally disables trigger 14 unless it is in its actuated position with the nose piece of guide body 6 in contact with a workpiece; thus, tool 1 will not operate unless trigger 14 and safety 19 are actuated at the same time.

Figure 3A:
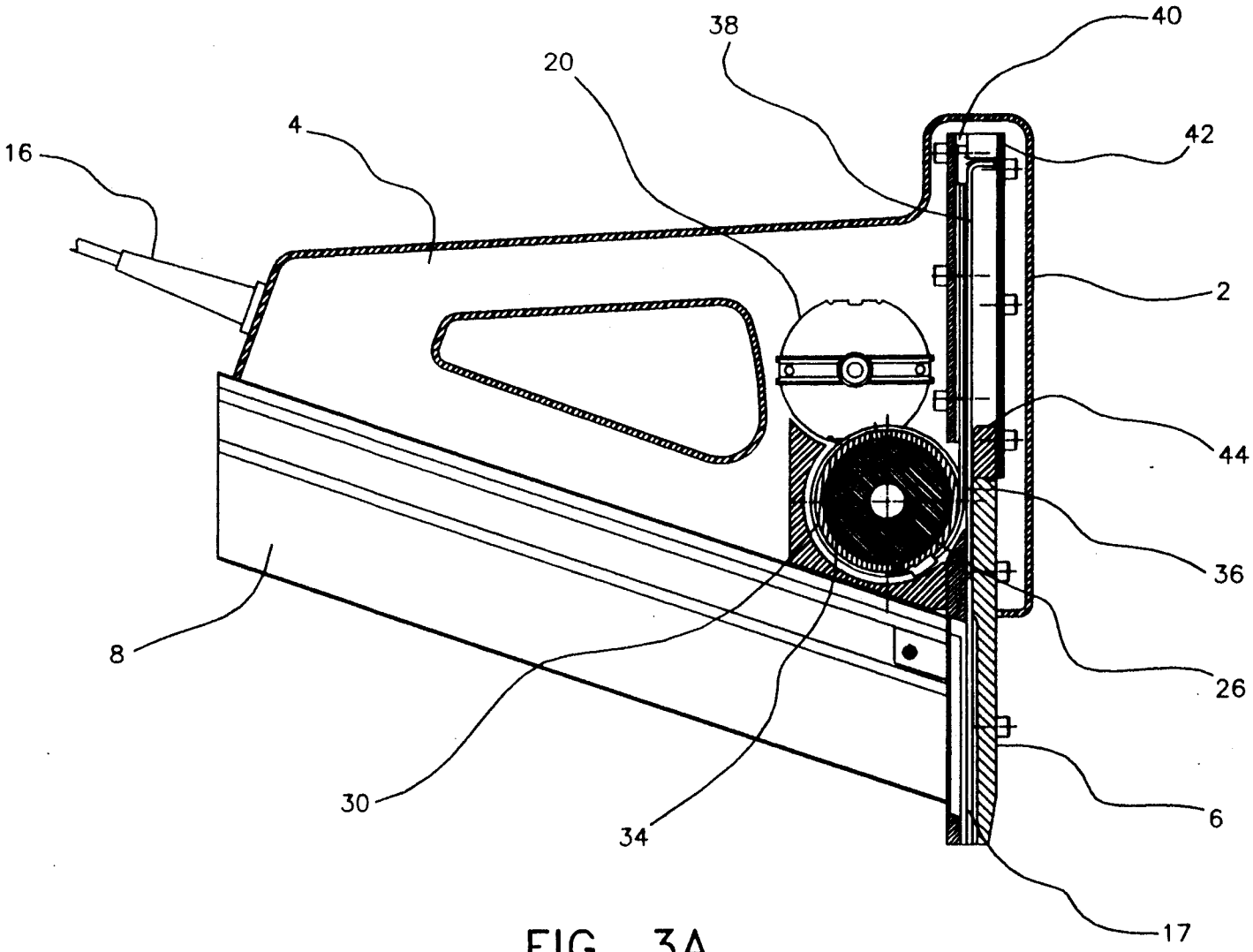
FIG. 3A is a cross-sectional view taken along section line 3—3 of FIG. 2 when the tool is in the unactuated position.
Figure 3B:
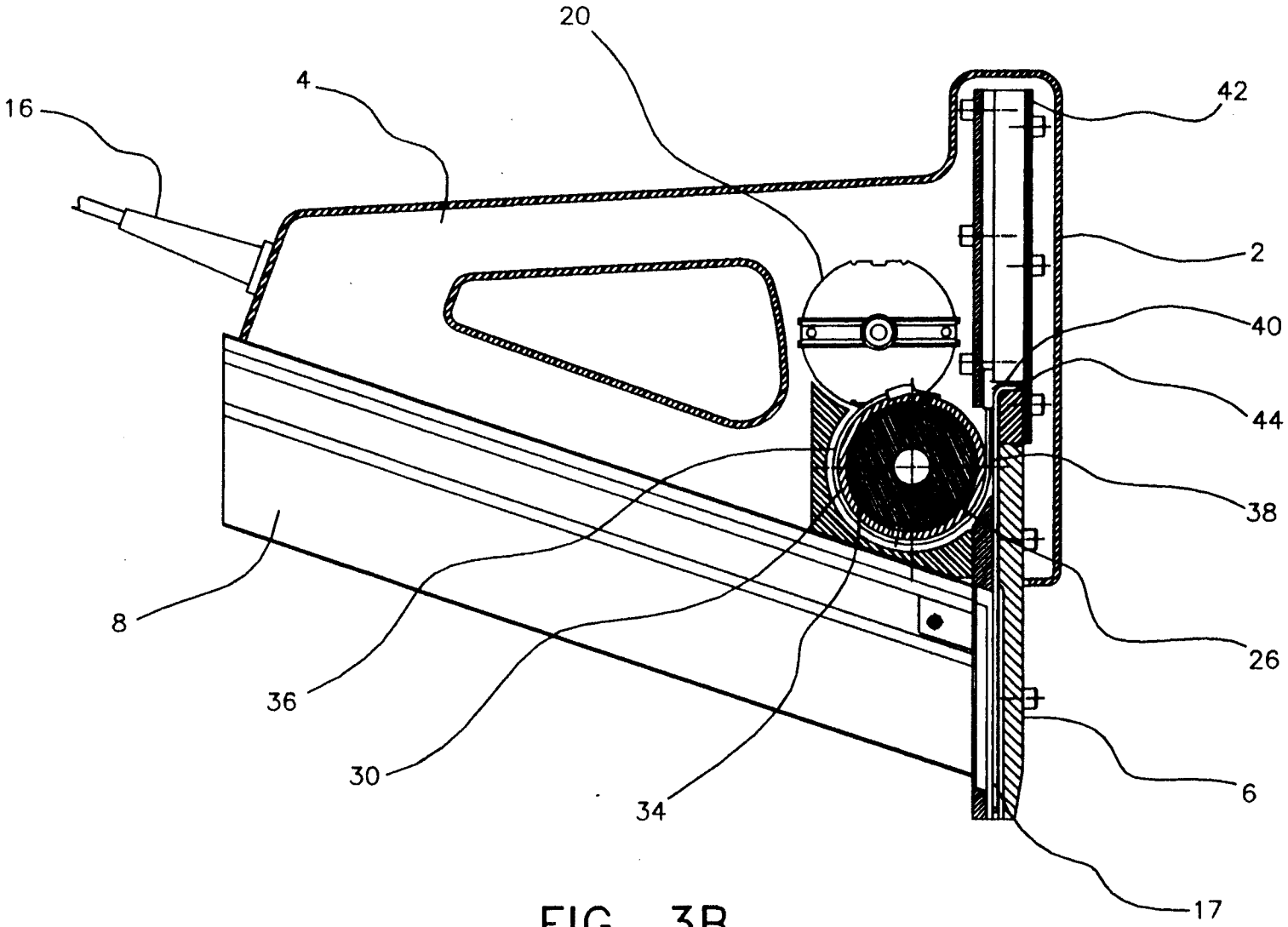
FIG. 3B is a cross-sectional view taken along section line 3—3 of FIG. 2 when the tool is in the actuated position.
Figure 7A:
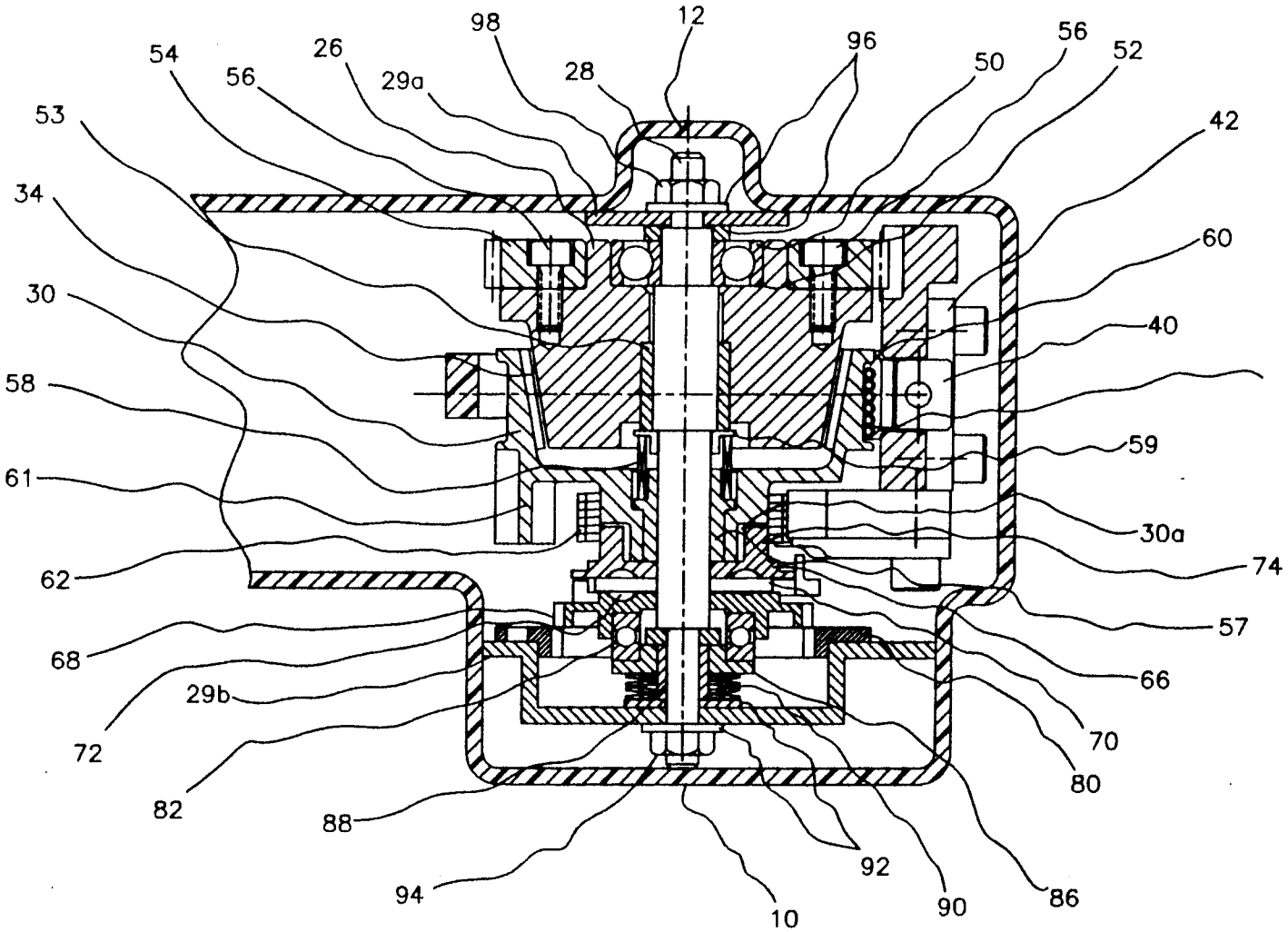
FIG. 7A is a fragmentary cross-sectional view taken along section line 7—7 of FIG. 1 when the tool is in the unactuated position.
Figure 8:
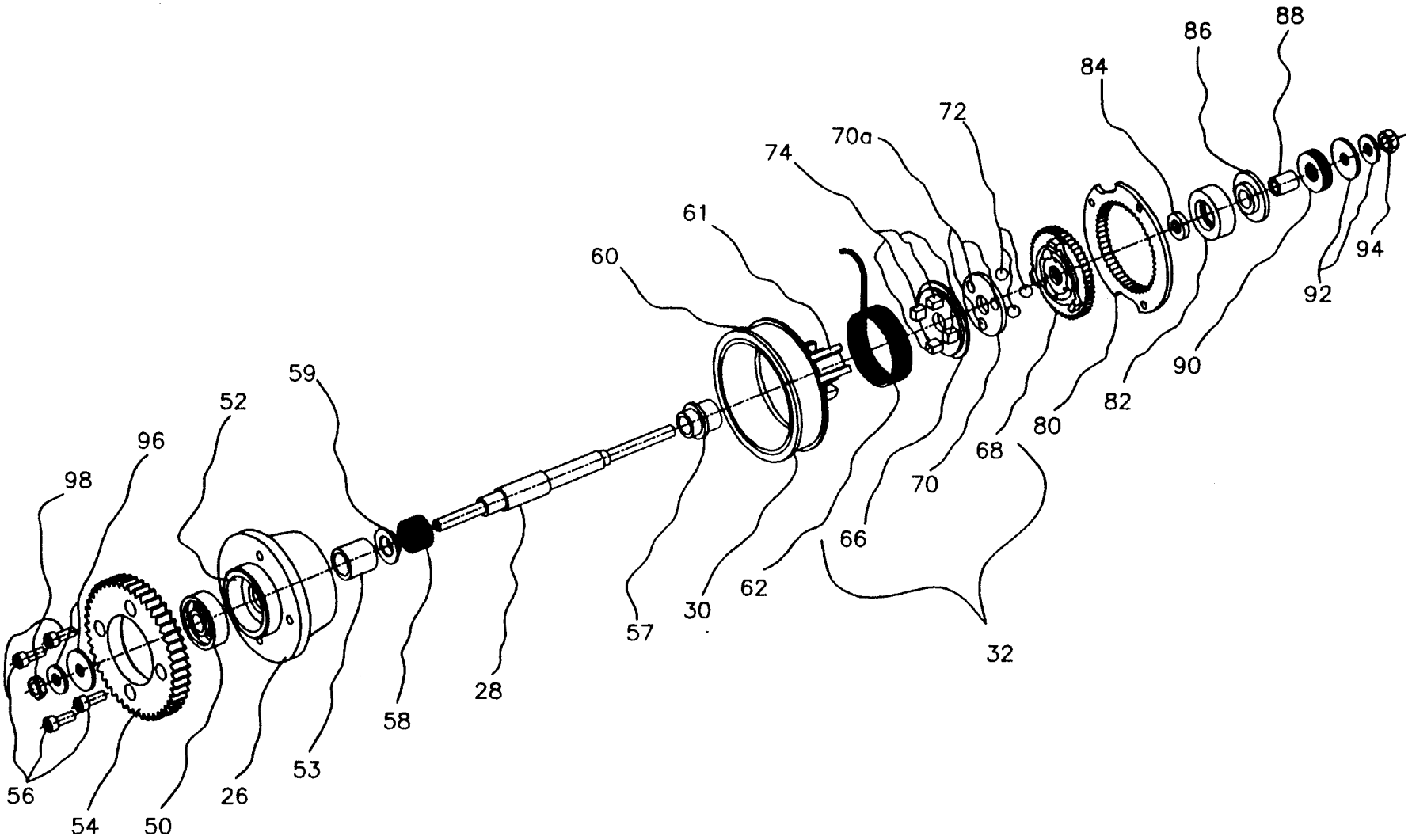
FIG. 8 is an exploded view of the flywheel, drum, and clutch actuator assembly of the present invention.
Figure 9:
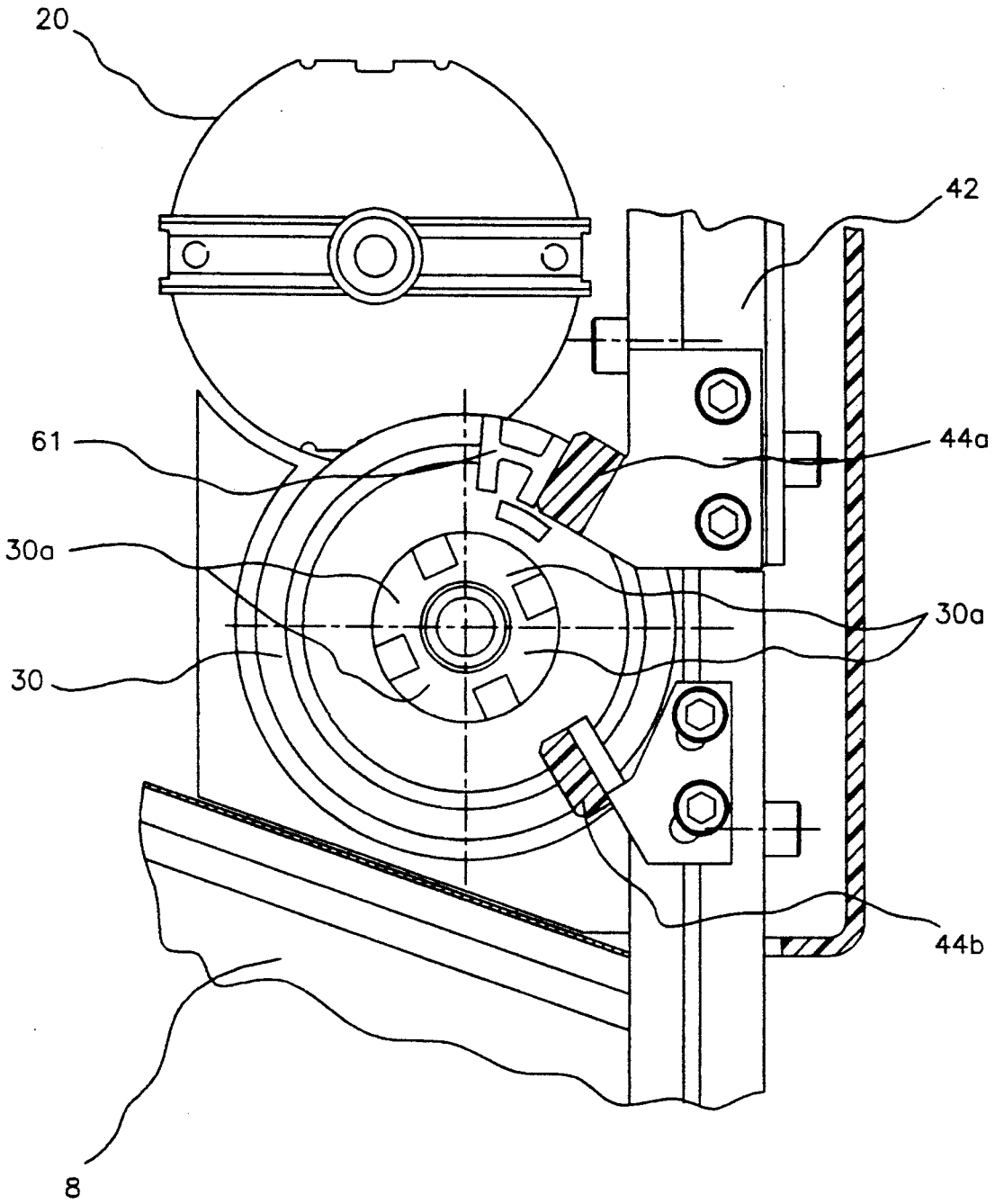
FIG. 9 is a fragmentary cross-sectional view taken along section line 9—9 of FIG. 5B.

Referring now to FIGS. 3A & B, 4, and 6, the operating mechanism for tool 1 can be more clearly seen. A prime mover in the form of an electric motor 20 is mounted within main body portion 2. A drive gear 25 is rigidly affixed to the output shaft 20*a* of motor 20. A conically shaped flywheel 26 is rotatably mounted on a fixed shaft 28 within main body portion 2 below motor 20. Shaft 28 is affixed within main body portion 2 by a pair of mounting brackets 29*a* and 29*b* (FIGS. 7A and B). Mounted on the same shaft 28 is a conical drum 30 and a clutch actuator assembly 32 (FIG. 8). The conical outer surface of flywheel 26 is shaped such that it cooperates with the inner conical surface of drum 30. Located along the inner circumference of drum 30 is a frictional lining 34. Wound around the outer circumference of drum 30 is a cable 36. Cable 36, which is preferably composed of either a flat, stiff mesh composition or a series of individual steel cables arranged to form a single flat cable, is attached at one end to drum 30, while at its opposite end cable 36 is coupled to a driver blade 38 by a mounting block 40. Mounting block 40 is located within a driver frame 42 and is slidable between an unactuated position at the top of driver frame 42 and an actuated position at the bottom of driver frame 42. A resilient driver stop 44 is located at the bottom of driver frame 42 such that the angled portion of driver blade 38 will strike stop 44, which absorbs any energy remaining at the end of the drive stroke. Also located on driver frame 42 is a pair of drum stops 44*a* and 44*b* (FIG. 9).

Figure 7B:
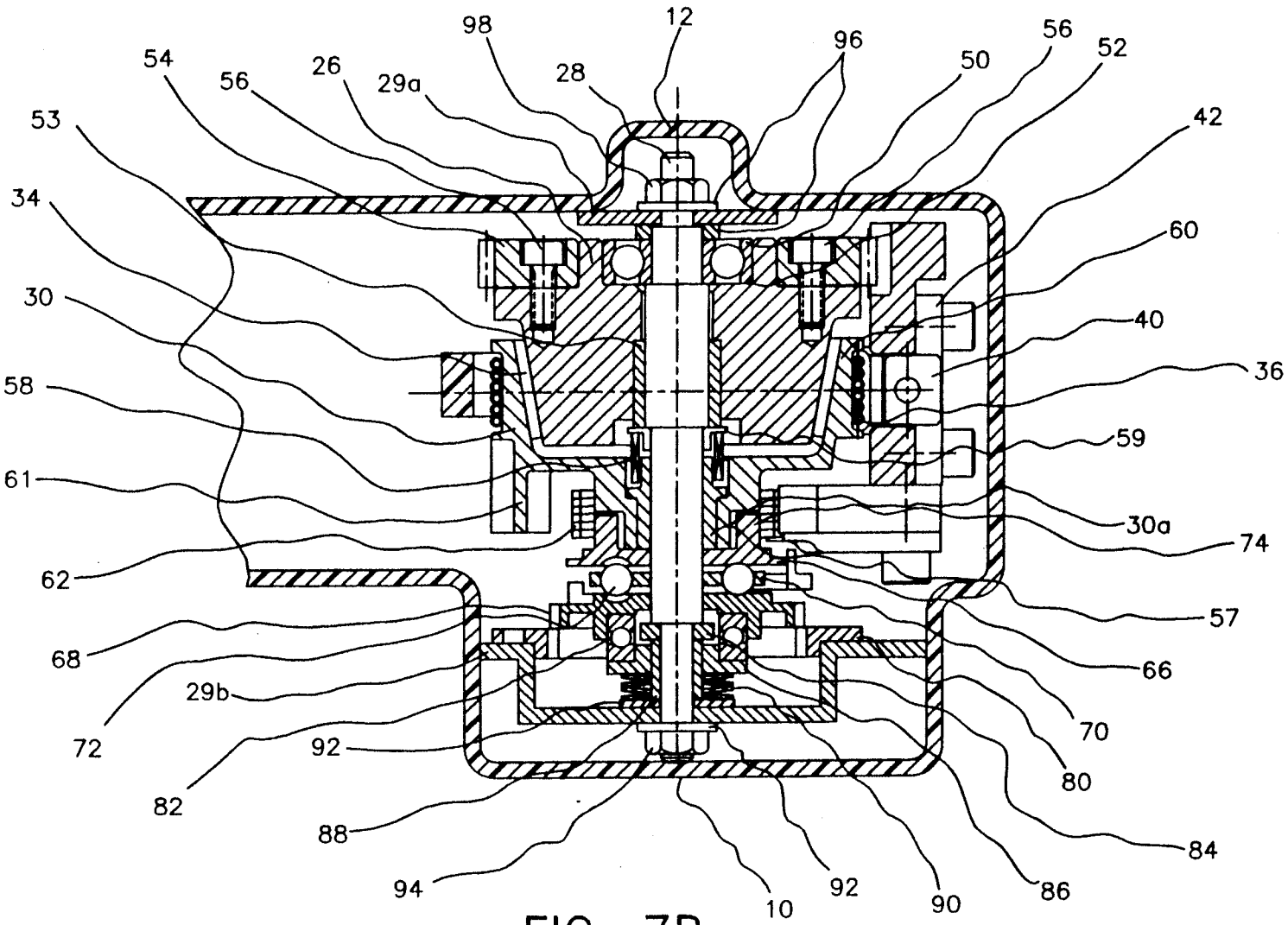
FIG. 7B is a fragmentary cross-sectional view taken along section line 7—7 of FIG. 1 when the tool is in the actuated position.

FIGS. 7A and 7B most clearly illustrate the flywheel, drum, and clutch actuator assembly of the present invention. Flywheel 26 is rotatably mounted on shaft 28 by a ball bearing 50, which is pressed into a recess 52 in flywheel 26, and a roller bearing 53. A gear 54 is rigidly affixed to flywheel 26 by use of screws 56. Flywheel gear 54 meshes with drive gear 25 of motor 20 such that flywheel 26 rotates in cooperation with motor 20.

Drum 30 is also rotatably mounted on shaft 28 by a bushing 57 which is pressed into drum 30. The inner surface of drum 30 is conically shaped, and a strip of frictional material 34 is affixed to the inner peripheral surface of drum 30. Drum 30 is shiftable along shaft 28 with respect to flywheel 26, with a spring 58 located between bushing 57 and a spacer 59 biasing drum 30 away from flywheel 26. A trough or channel 60 is located on the outer periphery of drum 30, such that driver cable 36 can be wound around drum 30 within trough 60. Drum 30 also contains a stop lug 61 protruding from its outer surface. Finally, a torsion spring 62 is coupled to drum 30, with its opposite end affixed to main body 2.

The clutch actuator assembly of the present invention is most clearly shown in FIGS. 7A, 7B, and 8. Clutch actuator assembly 32 consists primarily of a pusher plate 66 and a toothed wheel 68 which are rotatably mounted on shaft 28. Located between plate 66 and wheel 68 is a thin metal or plastic disk 70. Disk 70 contains three equally spaced holes 70*a*. Three metal ball bearings 72 are contained within holes 70*a* of disk 70 and are captive between plate 66 and wheel 68. Wheel 68 also contains three equally spaced lugs 73 which protrude toward plate 66.

Plate 66 is coupled for rotation to drum 30 by virtue of a series of four extensions 74 which fit into four corresponding depressions 30*a* (FIG. 9) on the outer surface of drum 30. This configuration enables plate 66 and drum 30 to rotate together. In addition, a flat surface 75 is located on the outer peripheral edge 76 (FIG. 10A) of plate 66.

One surface of wheel 68 contains a series of three equally spaced ramps 68*a* (FIG. 10B) corresponding to ball bearings 72. At the beginning of each ramp 68*a* there is a spherical pocket 68*b* for receiving bearings 72. In addition, the rear surface of plate 66 also contains a series of three equally spaced ramps 66*a* (FIG. 10A) which correspond to ramps of wheel 68 and a spherical pocket 66*b* at the edge of each ramp 66*a* for receiving bearings 72. In addition, plate 66 and wheel 68 each contain a matching bearing race 66*c* and 68*c* respectively, which act to connect the ramps and pockets along a constant radius from the centerline of shaft 28.

A locking ring 80 is provided to hold wheel 68 in position during the driving sequence. The inner surface of ring 80 contains a series of teeth which correspond to the teeth on the outer periphery of wheel 68. Ring 80 is rigidly affixed within housing 10.

A bearing 82 is pressed into a recess in wheel 68 on the surface opposite ramps 68*a*. Bearing 82 cooperates with a series of spacers 84, 86, and 88 to ensure the proper positioning of clutch assembly 32 on shaft 28. Clutch actuator assembly 32 is held in position on shaft 28 by a spring 90, washers 92, and a nut 94. Spring 90 allows some lateral movement of assembly 32 in the direction opposite drum 30. At the opposite end of shaft 28, washers 96 and nut 98 are affixed to secure all of the aforementioned components in their respective positions along shaft 28.

Figure 4:
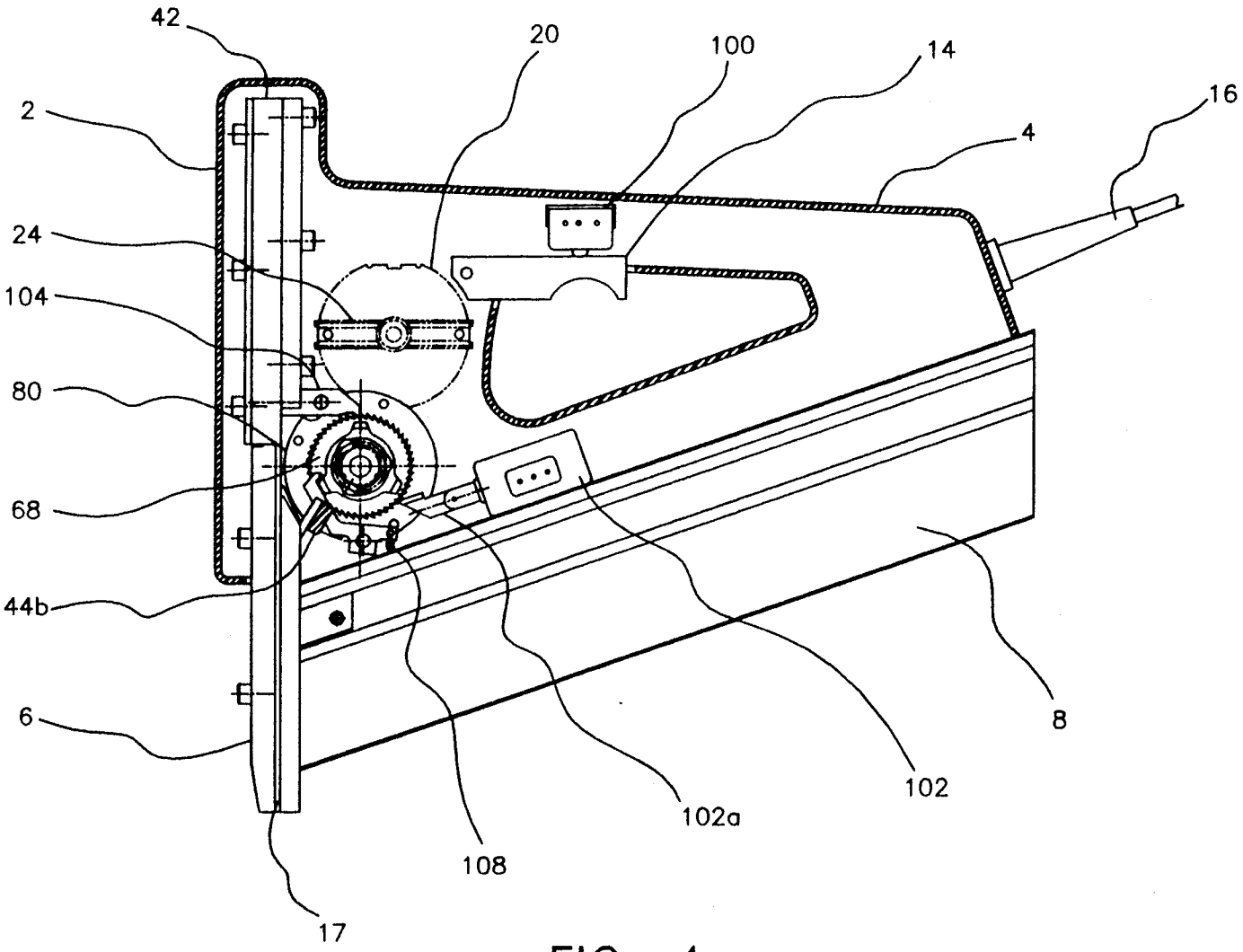
FIG. 4 is a cross-sectional view taken along section line 4—4 of FIG. 2.
Figure 5A:
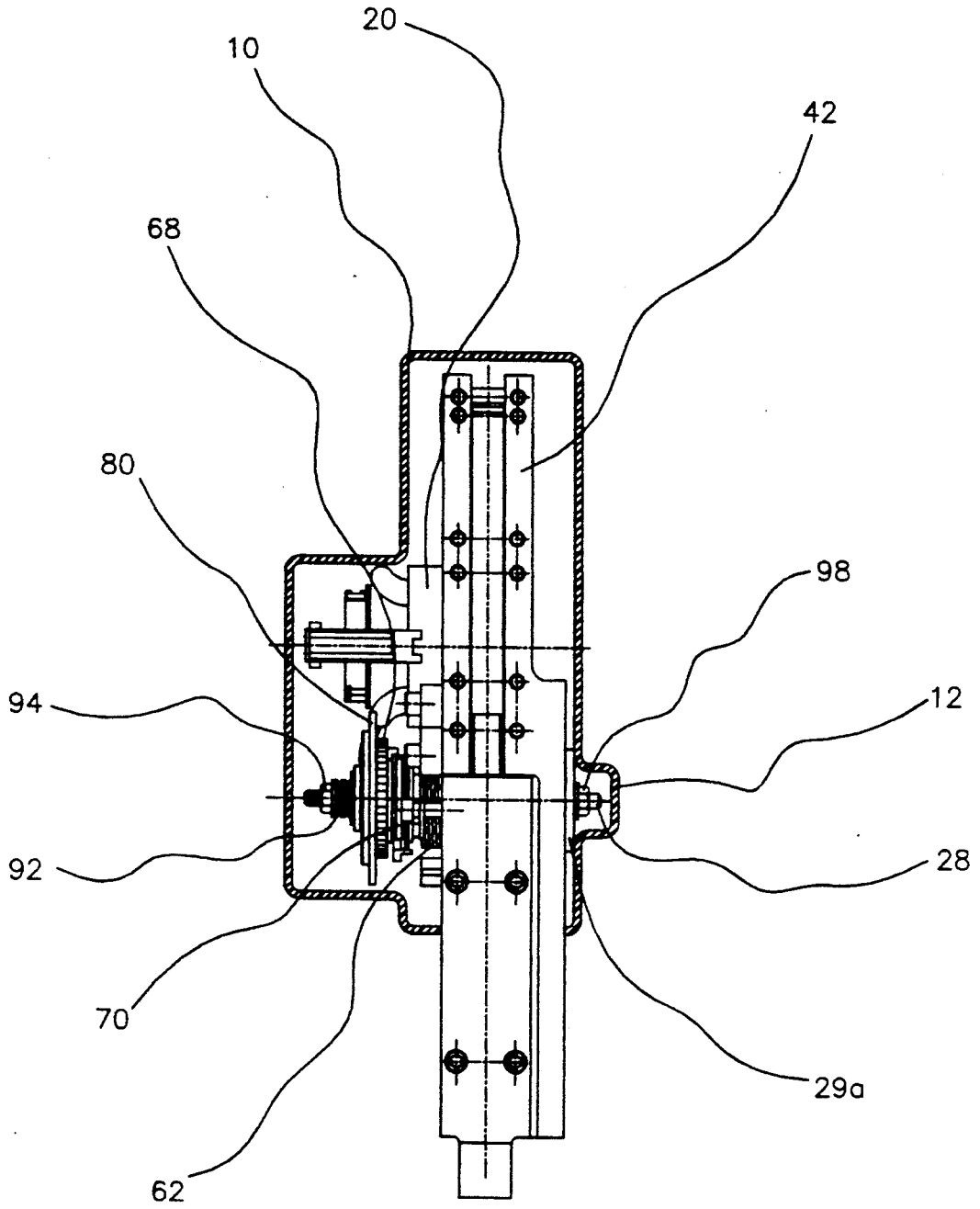
FIG. 5A is a cross-sectional view taken along section line 5—5 of FIG. 1 when the tool is in the unactuated position.
Figure 5B:
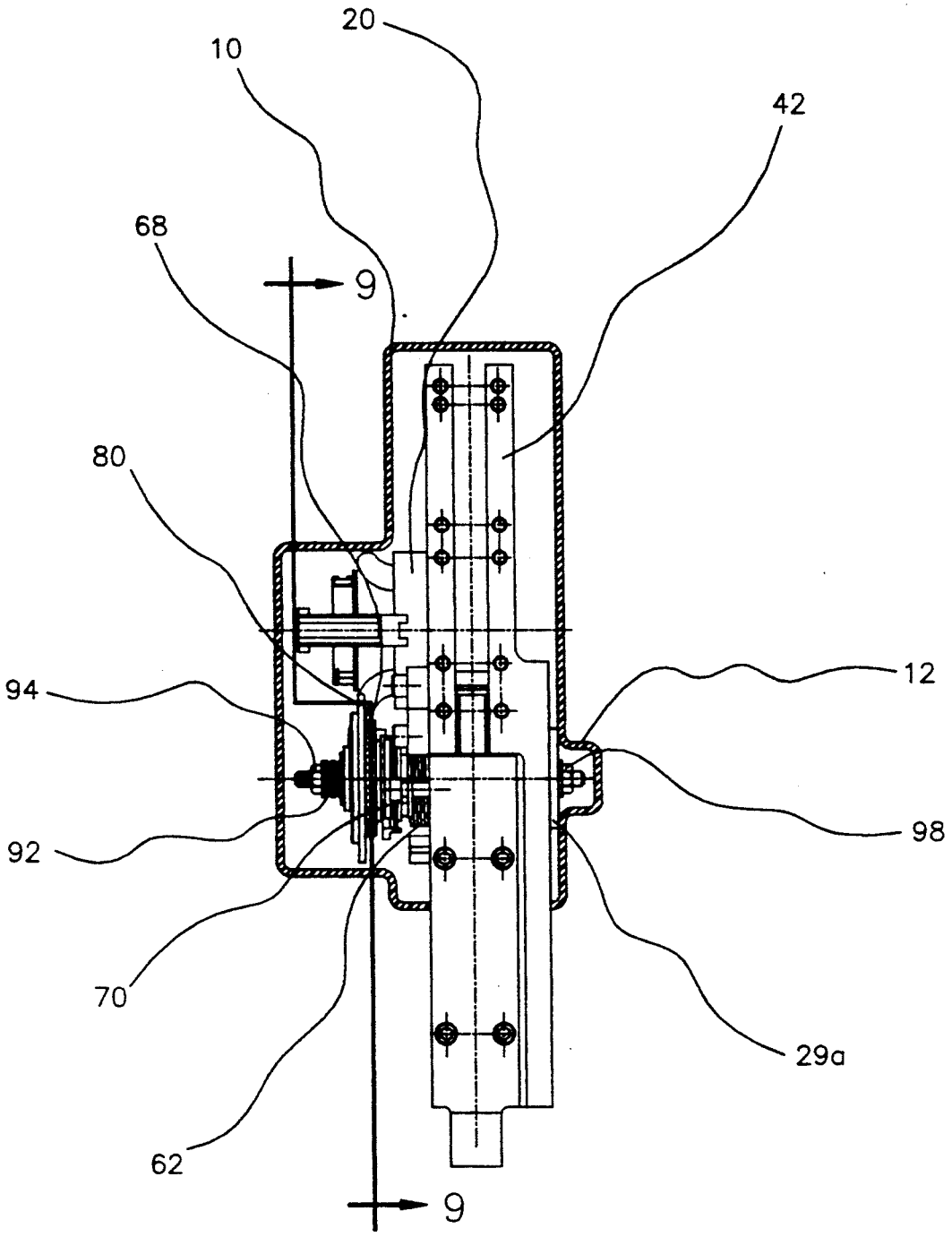
FIG. 5B is a cross-sectional view taken along section line 5—5 of FIG. 1 when the tool is in the actuated position.

Referring now to FIG. 4, the mechanism for controlling the operation of tool 1 can be most clearly seen. As previously described, in order to operate tool 1, both the trigger 14 and safety 19 must be actuated at the same time. Trigger 14 is mechanically coupled to a switch 100, such that when the operator of tool 1 activates trigger 14, switch 100 allows current to flow to a solenoid 102. A plunger 102*a* of solenoid 102 is positioned in contact with the teeth of wheel 68 such that when solenoid 102 is activated, plunger 102*a* causes wheel 68 to rotate in the clockwise direction as shown in FIG. 4. In the present embodiment, each activation of solenoid 102 causes wheel 68 to rotate between 35 degrees and 40 degrees.

Figure 10B:
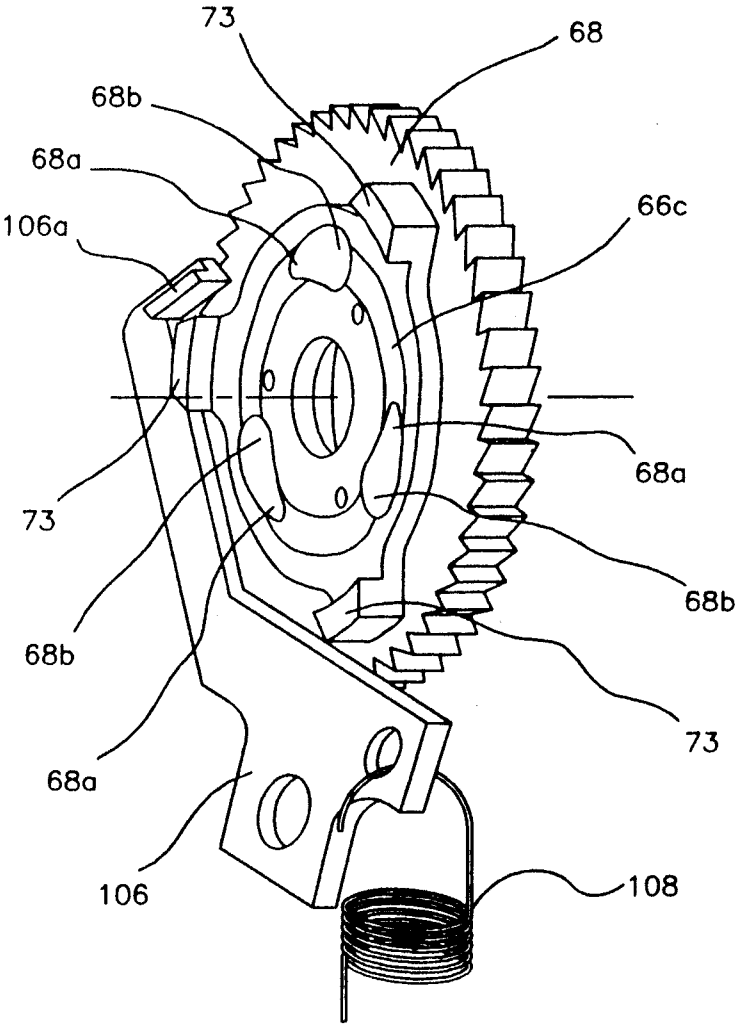
FIG. 10B is a perspective view of the toothed wheel of the present invention.
Figure 10A:
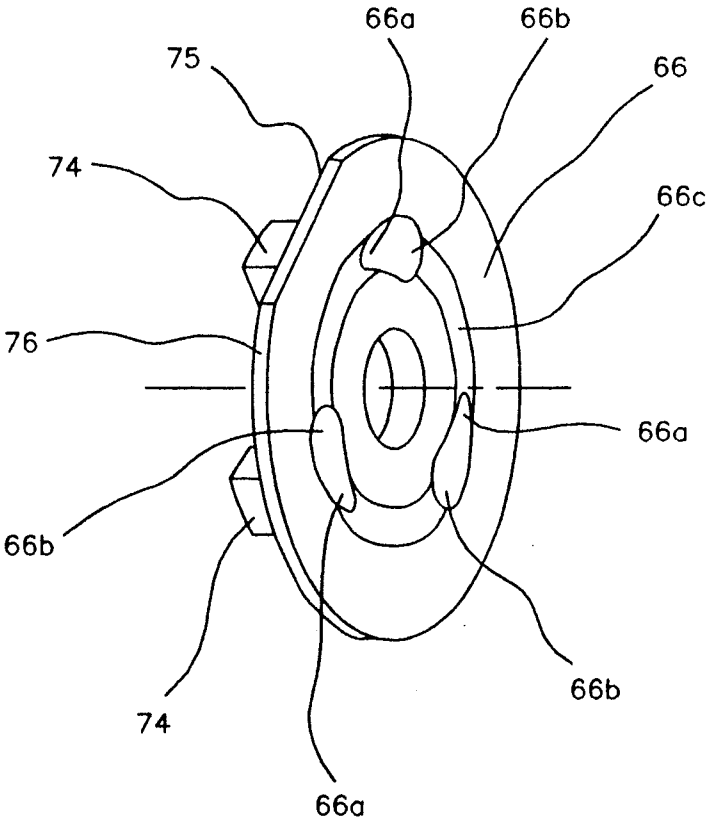
FIG. 10A is a perspective view of the pusher plate of the present invention.

In addition, a ratchet wheel pawl 104 is positioned in contact with the teeth of wheel 68 opposite plunger 102*a* of solenoid 102. The purpose of pawl 104 is to insure that wheel 68 will only rotate in a clockwise direction. Finally, a stop lever arm 106 is mounted within main body portion 2 adjacent locking ring 80. Lever arm 106 cooperates with lugs 73 of wheel 68 to provide a positive stop for wheel 68 as it rotates to the next position, as can be seen in FIG. 10B. A lug 106*a* is located on the side of the forwardmost portion of arm 106. Lever arm 106 is biased to its normal position by a spring 108.

The fastener driving tool of the present invention having been described in detail, its operation can now be set forth. The tool operator first connects tool 1 to a source of electrical current by means of power cord 16. The operator next loads magazine 8 with a strip of nails. A feeder shoe (not shown) urges the nail strip forwardly within magazine 8 such that the forwardmost nail of the strip is located in drive track 19 of guide body 6. At this point, tool 1 is ready for use. Grasping tool 1 by handle portion 4, the operator activates motor switch 18, causing output shaft 20*a* of motor 20 to rotate. Drive gear 25, which is rigidly affixed to shaft 20*a*, rotates in synchronization with motor 20. Drive gear 25 is constantly meshed with flywheel gear 54; thus, flywheel gear 54 and flywheel 26, which is rigidly affixed to flywheel gear 54, both rotate about shaft 28, which is nonrotatably affixed within main body 2.

When the operator wishes to drive a fastener into a workpiece, he pushes safety 19 located at the end of guide body 6 against the surface of the workpiece and manually activates trigger 14. Trigger 14 activates switch 100, which is electrically coupled to solenoid 102. Solenoid plunger 102*a* is moved forward when solenoid 102 is energized, causing toothed wheel 68 of actuator assembly 32 to rotate about shaft 28.

As wheel 68 rotates, ball bearings 72 within plate 70 contact the ramp portions 68*a* and 66*a* of toothed wheel 68 and plate 66, respectively. As wheel 68 continues to rotate, the action of ball bearings 72 against the ramps forces plate 66 and wheel 68 to separate, as can be seen in FIG. 7B. As plate 66 is forced away from wheel 68, extensions 74 push against drum 30, causing it to move toward flywheel 26. When drum 30 has moved a short distance (approximately 0.050 inches in the present embodiment), frictional surface 34 contacts the periphery of rotating flywheel 26, causing drum 30 and flywheel 26 to rotate together. As wheel 68 is prevented from rotating in the clockwise direction by ratchet pawl 104 (FIG. 4), ball bearings 72 climb the remainder of the ramps by virtue of the energy stored in flywheel 26, pushing plate 66 and wheel 68 further apart, and thus compressing spring 90 to provide the normal force to actuate the clutch.

Driver cable 26, which is rigidly affixed to drum 30, now begins to wrap around the outer surface of drum 30 within trough 60 as drum 30 rotates. The opposite end of cable 36, which is coupled to driver 38, pulls driver 38 downward within driver frame 42, forcing driver blade 38 through drive track 17, forcing the forwardmost nail out of drive track 17 into the workpiece. As wheel 68 is shifted away from plate 66, the teeth of wheel 68 mesh with the corresponding teeth on the inner surface of locking ring 80, causing wheel 68 to be held in a stationary position within ring 80 (see FIG. 7B) while plate 66 and wheel 68 are apart and during the drive stroke.

At the end of the drive stroke, the angled portion of driver blade 38 contacts driver stop 44. An additional positive stop is provided for when lug 61 of drum 60 contacts upper stop 44*a* . At approximately the same time, ball bearings 72 fall into pockets 66*b* located in plate 66, and into pockets 68*b* in wheel 68, removing the force which caused drum 30 to shift into frictional engagement with rotating flywheel 26. Spring 58, which was compressed when drum 30 was shifted into engagement with flywheel 26, now acts to disengage drum 30 from flywheel 26, forcing drum 30 away from flywheel 26 toward actuator assembly 32: In addition, as ball bearings 72 fall into the pockets 68*b* in wheel 68, the force stored in compressed spring 90 shifts toothed wheel 68 out of engagement with locking ring 80 and back to its unactuated position as shown in FIG. 7A.

As drum 30 disengages from flywheel 26, torsion spring 62, which is coupled to drum 30 and was tensioned as drum 30 rotated while engaged with flywheel 26, causes drum 30 to rotate in the opposite direction from flywheel 26 until lug 61 contacts lower stop 44*b*. As drum 30 rotates under the force of spring 62, cable 36 unwinds from the outer peripheral surface of drum 30, causing driver blade 38 to be forced upward from its actuated position to its normal, unactuated position.

As drum 30 rotates to its unactuated position, plate 66 rotates in synchronization by virtue of the interaction of extension 74 of plate 66 with the depressions 30*a* of drum 30. Correspondingly, wheel 68, which is rotatably affixed to plate 66 by virtue of ball bearings 72 captive in pockets 68*b* and 66*b*, also rotates to the same angular position. As wheel 68 reaches its unactuated position, it is stopped from any further rotation (due to inertia stored in wheel 68) by stop lever arm 106, which contacts one of lugs 73 which protrude from wheel 68, as can be seen in FIG. 10B.

Since it is necessary for wheel 68 to rotate 240 degrees with each activation of the tool, stop lever arm 106 must bypass every other lug 73 during its return cycle. This is accomplished by the flat surface 75 on plate 66. As wheel 68 starts rotating to its unactuated position, the camming surface 76 of plate 66 is engaged by lug 106a to shift lever arm 106 away from wheel 68 as the first lug 73 passes. Flat surface 75 on the edge of plate 66 allows lug 106a to move into position to stop the rotation of wheel 68 by contacting the next lug 73.

When driver 38, during its return stroke, moves out of drive track 17 of guide body 6, the feeder shoe will assure that the next forwardmost nail of the strip will be positioned within drive track 17. At this point, tool 1 is in condition to repeat the nail driving sequence.

While the invention has been shown and described in terms of a preferred embodiment thereof, it will be understood that this invention is not limited to this particular embodiment and that many changes and modifications may be made without departing from the true spirit and scope of the invention as defined in the appended claims.

What is claimed is:

1. A tool for driving fasteners, comprising:

a housing;

a fastener containing magazine attached to said housing;

a prime mover located within said housing;

a flywheel mechanically coupled to said prime mover and rotatably mounted on an axis;

a drum, mounted on an axis, shiftable along the axis to a position of frictional engagement with said flywheel;

a fastener driver, located within said housing, shiftable between a first unactuated position and a second fastener driving position;

means for coupling said driver to said drum; and means for shifting said drum into frictional engagement with said flywheel, whereby said driver is shifted by said coupling means from said first position to said second position.

2. The tool of claim 1, wherein said coupling means comprises a metal cable.

3. The tool of claim 2, wherein said cable consists of a plurality of individual cables coupled in a single plane.

4. The tool of claim 1, whereby said flywheel has a conically shaped outer periphery and said drum has a corresponding conically shaped internal surface.

5. The tool of claim 4, wherein the internal surface of said drum is lined with a material to improve frictional engagement.

6. The tool of claim 4, wherein said drum shifting means further comprises a clutch assembly, located coaxially with respect to said flywheel and said drum and rotatable about said axis, for shifting said drum into said position of frictional engagement with said flywheel, said clutch assembly comprising:

a toothed wheel having a plurality of ramps located on one side;

a pusher plate, having a plurality of ramps located on the side adjacent said wheel corresponding to said ramps on said wheel;

and a plurality of ball bearings, located between said wheel and said plate, corresponding to said ramps, whereby rotation of said clutch assembly causes said ball bearings to contact said ramps and shift said pusher plate into contact with said drum.

7. The tool of claim 6, wherein said outer periphery of said flywheel contains a channel within which said coupling means is wound when said fastener driver is in said first unactuated position.

8. The tool of claim 7, further comprising a torsion spring coupled to said flywheel for returning said fastener driver from said second fastener driving position to said first unactuated position.

9. The tool of claim 8, further comprising means for activating said clutch assembly.

10. The tool of claim 9, wherein said clutch activating means includes a solenoid having a plunger positioned to contact said toothed wheel, and a trigger means electrically coupled to said solenoid, such that when said trigger means is activated, said plunger rotates said toothed wheel and activates said clutch assembly.

11. The tool of claim 4, wherein said drum contains a stop lug extending from its outer surface.

12. The tool of claim 11, further comprising a frame contained within said housing, and a plurality of stops attached to said frame, such that rotation of said drum is limited by said stop lug contacting said stops.

13. The tool of claim 4, wherein said drum has an outer surface containing a plurality of outwardly extending spaced apart lugs on said outer surface.

14. The tool of claim 13, further comprising a stop arm for cooperating with the lugs of said drum to stop the rotation of said drum.

15. The tool of claim 1, further comprising a spring for biasing said drum away from said flywheel.

16. The tool of claim 1, further comprising means for returning said driver from said second fastener driving position to said first unactuated position.

17. The tool of claim 1, wherein said drum shifting means further comprises a clutch assembly, located along said axis with respect to said flywheel and said drum and rotatable about said axis, for shifting said drum into said position of frictional engagement with said flywheel.

18. The tool of claim 17, wherein said clutch assembly comprises: a toothed wheel having a plurality of ramps located on one side; a pusher plate, having a plurality of ramps located on the side adjacent said wheel corresponding to said ramps on said wheel; and a plurality of ball bearings, located between said wheel and said plate, corresponding to said ramps, whereby rotation of said clutch assembly causes said ball bearings to contact said ramps and shift said pusher plate into contact with said drum.

19. The tool of claim 18, wherein said clutch assembly further comprises a disk, positioned between said wheel and said plate, having a plurality of apertures for positioning said ball bearings, whereby the rotation of said clutch assembly causes said ball bearings to contact said ramps and shift said toothed wheel away from said pusher plate.

20. The tool of claim 19, further comprising a locking ring having a toothed inner periphery corresponding to said toothed wheel for holding said toothed wheel in a stationary position after said wheel is shifted away from said pusher plate.

21. The tool of claim 1, further comprising means for stopping said driver when it has reached said second fastener driving position.

22. An electromechanical tool for driving fasteners into a workpiece, comprising:

a housing;

a magazine for holding fasteners affixed to said housing;

a driver shiftable through a work stroke between a normal retracted position and an extended fastener driving position;

a guide body affixed to said housing adjacent said magazine defining a drive track for said driver;

a motor located within said housing;

a stationary shaft rigidly affixed within said housing;

a conically shaped flywheel, rotatably affixed to said shaft and mechanically coupled to said motor for rotation;

a drum,rotatably affixed to said shaft and mounted on said shaft adjacent said flywheel, having a conical shape corresponding to said flywheel and shiftable along said shaft to a position of frictional engagement with said flywheel;

a driver shifting means, coupled at one end to said driver and at the other end to said drum, capable of being wound about said drum for shifting said driver between said normal and said extended positions;

and a clutch assembly for shifting said drum into frictional engagement with said flywheel;

whereby when said clutch assembly is activated, said drum is shifted into frictional engagement with said rotating flywheel, causing rotation of said drum and shifting said driver from said normal retracted position through a work stroke to said extended fastener driving position.

23. The tool of claim 22, further comprising a torsion spring for returning said driver to its normal retracted position after the work stroke is complete.

24. The tool of claim 22, wherein said driver shifting means comprises a metal cable.

25. The tool of claim 22, wherein said clutch assembly comprises:

a pusher plate, rotatably affixed to said shaft and mechanically coupled to said drum, containing a plurality of ramps located on its surface away from said drum;

a wheel, rotatably affixed to said shaft, having a toothed outer periphery and containing a plurality of ramps located on its surface toward said plate, a thin disk, positioned on said shaft between said plate and said wheel, having a plurality of apertures;

and a plurality of ball bearings located within the apertures of said disk;

such that rotation of said wheel causes said ball bearing to contact the ramps of said plate and said wheel, whereby shifting said drum into frictional engagement with said flywheel.

26. The tool of claim 25, further comprising means for activating said clutch assembly.

27. The tool of claim 26, wherein said clutch activating means include a solenoid having a plunger positioned to contact the outer periphery of said toothed wheel, and a trigger means electrically coupled to said solenoid, such that when said trigger means is activated, said plunger rotates said toothed wheel and activates said clutch assembly.

28. The tool of claim 25, further comprising means for stopping the rotation of said drum when said driver has reached said extended fastener driving position.

29. The tool of claim 22, wherein the internal surface of said drum is lined with a material to improve frictional engagement.

30. The tool of claim 22, further comprising a spring for biasing said drum away from said flywheel.

* * * * *